United States Patent [19]

Lenorak

[11] 3,956,875

[45] May 18, 1976

[54] MULTI-TWIST SPINDLE

[75] Inventor: Ferdinand Lenorák, Bratislava, Czechoslovakia

[73] Assignee: Slovenska vedecko-technicka spolocnost Dom techniky, Bratislava, Czechoslovakia

[22] Filed: June 11, 1974

[21] Appl. No.: 478,287

[30] Foreign Application Priority Data

June 27, 1973 Czechoslovakia ..... 4612-73

[52] U.S. Cl. ..... 57/58.61; 57/58.63; 57/58.83

[51] Int. Cl.[2] ..... D01H 7/86

[58] Field of Search ..... 57/58.61, 58.63, 58.49, 57/58.52, 58.7, 58.83, 58.86, 58.65, 58.67, 58.68

[56] References Cited

UNITED STATES PATENTS

| | | | |
|---|---|---|---|
| 1,690,373 | 11/1928 | Marchev | 57/58.61 X |
| 2,099,876 | 11/1937 | Weaver | 57/58.61 X |
| 2,526,147 | 10/1950 | MacCreadie | 57/58.61 X |
| 2,910,823 | 11/1959 | Bunch | 57/58.63 X |
| 3,147,581 | 9/1964 | Godderidge | 57/58.63 |

FOREIGN PATENTS OR APPLICATIONS

| | | | |
|---|---|---|---|
| 272,803 | 4/1951 | Switzerland | 57/58.63 |

*Primary Examiner*—John Petrakes

[57] ABSTRACT

Multi-twist spindle having a supporting element for a feeding bobbin carrying a coil of an elongated strand, a brake through which the strand from the bobbin passes to an inner main carrier, and an inner auxiliary carrier driven by an inner main pulley, and an inner auxiliary pulley, the two said pulleys being speed and phase synchronized by a transmission including an elongated shaft spanning the distance between the two pulleys. After passing through the inner auxiliary carrier the strand goes through an outer main carrier and an outer auxiliary carrier rotating in a direction opposite to the inner carriers and carried by aligned outer main shafts which are speed and phase synchronized. Each set of main and auxiliary carriers constitutes a carrier couple which carries out two twists of the strand per one revolution.

3 Claims, 1 Drawing Figure

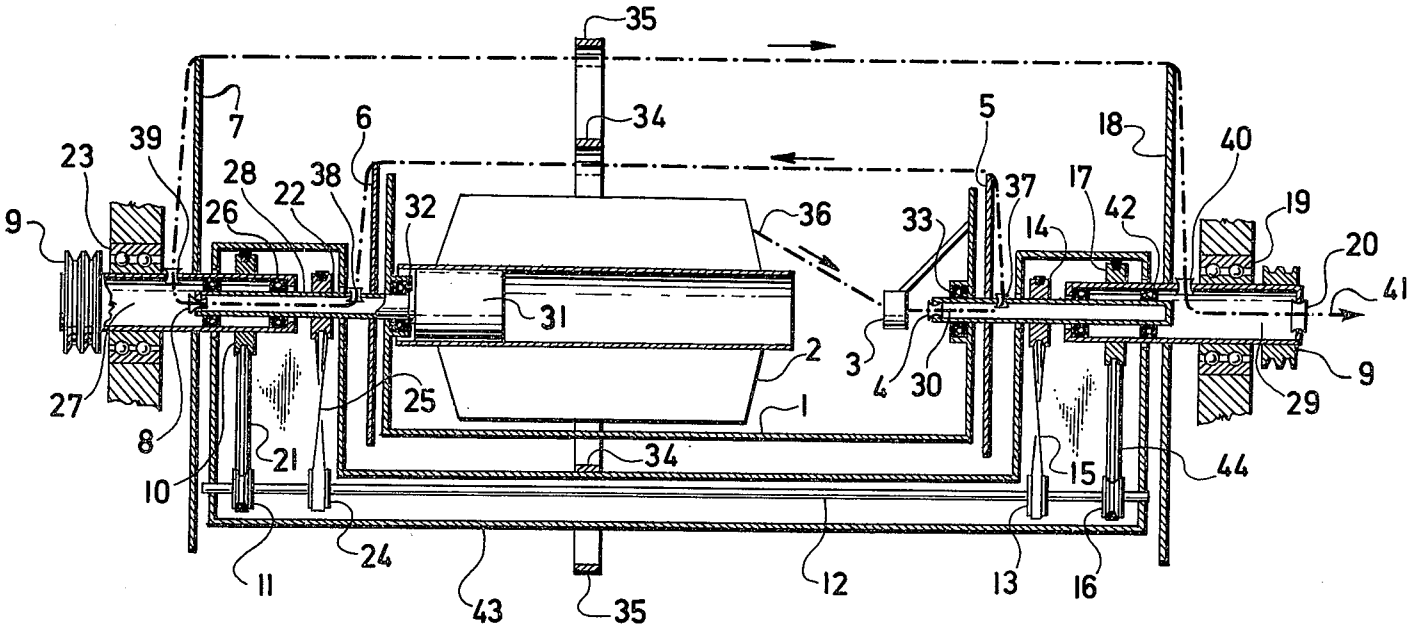
41
20
9
19
29
40
44
18
42
16
17
15
14
13
37
5
33
30
4
3
12
36
2
1
35
34
34
35
31
43
32
25
6
24
38
22
21
11
28
26
7
39
8
10
23
27
9

MULTI-TWIST SPINDLE

This invention relates to a multi-twist spindle for twisting an elongated strand.

Until now strands composed of a plurality of fibers have been twisted by double-twist or two-for-one spindles, ring spindles, fly frames, or classic spindles with a rotating feeding bobbin, etc.

The main disadvantage of these kinds of twisting devices resides in the fact that they do not produce a high number of twists per revolution. As a result, the speed of winding performed by the machines is low as compared to the speed of winding which the strand material could withstand in processing.

The above disadvantages are overcome by a multi-twist spindle in accordance with the invention; this spindle employs a feeding bobbin carrying an elongated strand, the strand being twisted by the speed and phase synchronized rotation of a couple of an inner main and auxiliary carrier. Such twisting couple imparts two twists to the strand during each of their revolutions. By increasing the number of twisting couples, successive couples being speed and phase synchronized and rotating in opposite directions, there may be created a multi-twist spindle which produces four, six or eight twists per revolution of the carrier couples, for example, and by rotating the supply bobbin, one can secure either an additive further twist, thereby yielding an odd number of twists, or, if the supply bobbin is rotated in the opposite direction, one may secure a substractive further twist, thereby yielding an odd but lesser number of twists.

The main carrier of each couple is a mirror image of the auxiliary carrier.

The invention will now be described, by way of example, with reference to the accompanying drawing.

In the drawing:

The single FIGURE is a schematic view in side elevation of a preferred illustrative embodiment of a multi-twist spindle in accordance with the invention.

The illustrative multi-twist spindle has a supporting element 1 for the holder 31 of a feeding bobbin 2, the supporting element 1 being carried by aligned axially spaced bearings 32 and 33. Upon leaving the bobbin 2 the strand 36 travels to the right in the drawing to a strand-retarding brake 3, a central guide 4, axially through the hollow right hand central shaft 30 and radially outwardly through an eye in an inner main carrier 5 which is fixedly secured to the shaft 30. Shaft 30 carries an inner main pulley 14 affixed thereto. The strand 36 then passes to the left through an eye in an inner auxiliary carrier 6 which is affixed to a hollow shaft 28 coaxial of shaft 30, shaft 28 having an inner auxiliary pulley 22 affixed thereto. The shaft 28 and 30 are journalled in bearings 26 and 42, respectively, carried by axially spaced aligned stub shafts 27 and 29. shafts 27 and 29 are journalled in bearings 23 and 19, respectively, carried by fixed frame structure 43.

After passing through the auxiliary carrier 6, the strand passes radially with respect thereto to point 38, then longitudinally within the bore of the hollow shaft 28, to pass through a central guide 8 thereon, and then radially outwardly to pass through an eye in an outer main carrier 7 affixed to the shaft 27. An outer main pulley 10 is affixed to the shaft 27, as shown. After leaving the outer main carrier 7, the strand 36 passes to the right to an outer auxiliary carrier 18 affixed to an outer main shaft 29.

Speed and phase synchronisation between the twisting couples, and the driving of successive couples in counter-revolution, are effected as follows:

An elongated transmission shaft 12 extends beneath the supporting element 1. A belt 21 is entrained over the pulley 10 on shaft 27 and a pulley 11 on shaft 12. A belt 44 is entrained over a pulley 16 affixed to shaft 12 and a pulley 17 affixed to shaft 29. Belts 21 and 44 are untwisted, as shown. A twisted belt 25 is entrained over pulley 22 affixed to the shaft 38 and a pulley 24 affixed to the shaft 12. A pulley 13 is affixed to the shaft 12, and a twisted belt 15 is entrained over the pulley 14 affixed to shaft 37 and pulley 13. The outer main shafts 27 and 29 are driven in speed and phase synchronism by means of belts (not shown) entrained over pulleys 9 affixed to such respective main shafts. In the nomenclature employed hereinafter, the pulleys 10 and 17 are designated outer auxiliary and main pulleys, respectively, and pulleys 22 and 14 are designated inner auxiliary and main pulleys, respectively.

The described apparatus functions as follows:

The strand 36 passes from the bobbin 2 through the brake 3 and through an eye 4 into an eye 37 of the inner main carrier 5 rotated by the inner main pulley 14 which is connected by means of the crossed belt 15 to the main inner transmission pulley 13. The strand then goes through an eye 37 of the inner auxiliary carrier 6 which is rotated by the inner auxiliary pulley 22, pulley 22 being connected by means of the crossed belt 35 to the auxiliary transmission pulley 24. The strand 36 then goes through the guide eye 8 to the eye 39 of the outer main carrier 7 to the outer auxiliary carrier 18, and then through guides eyes 40 and 20 from which it emerges to pass to a winding mechanism (not specifically shown) at 41. The shaft 12 ensures a mutual synchronization of the couple of the outer carrier 7 and 18 and of the couple of the inner carriers 5 and 6, so that these couples work in counter-revolution. Between the carriers the strand 36 runs in spaces limited by anti-balloon devices or rings 34 and 35.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A multi-twist spindle comprising a supporting element for a feeding bobbin, a strand-retarding brake through which a strand passes from the feeding bobbin, an inner main carrier and an inner auxiliary carrier axially aligned therewith and spaced therefrom, an inner main pulley and inner auxiliary pulley driving the respective carriers, a main inner transmission means synchronizing the speed and phase of rotation of said inner carriers, said main inner transmission means including a transmission shaft, an outer main carrier and an outer auxiliary carrier, an outer main pulley and an outer auxiliary pulley, a main outer transmission means synchronizing the speed and phase of rotation of the outer main pulley and the outer auxiliary pulley, the main outer transmission means including said transmission shaft, and a central drive means including drive pulleys, the strand proceeding from the brake through the inner twisting couple composed of the inner main and auxiliary carriers and then through the outer twisting couple composed of the outer main and auxiliary carriers, the main inner transmission means and the main outer transmission means including means for driving the inner and outer twisting couples in opposite directions.

2. A multi-twist spindle according to claim 1, wherein said main outer transmission means includes an outer transmission pulley, and an outer belt and the main inner transmission means includes an inner auxiliary pulley, and inner auxiliary transmission pulley, and inner belt and an inner main pulley.

3. A multi-twist spindle according to claim 2, wherein the belts of one of said pairs of inner and outer belts are twisted and the belts of the other of said pairs of belts are untwisted.

* * * * *